US005279143A

United States Patent [19]

Dole

[11] Patent Number: 5,279,143

[45] Date of Patent: Jan. 18, 1994

[54] SELF-TRACKING ROLL FOR GROOVING THIN WALLED PIPE

[75] Inventor: Douglas R. Dole, Whitehouse Station, N.J.

[73] Assignee: Victaulic Company of America, Easton, Pa.

[21] Appl. No.: 4,796

[22] Filed: Jan. 15, 1993

[51] Int. Cl.[5] ..... B21D 17/04

[52] U.S. Cl. ..... 72/105

[58] Field of Search ..... 72/101, 105, 106

[56] References Cited

U.S. PATENT DOCUMENTS 3,648,503 3/1972 Harper ..... 72/105

3,754,424 8/1973 Costanzo ..... 72/105

3,995,466 12/1976 Kunsman ..... 72/105

4,041,747 8/1977 Elkin ..... 72/105

*Primary Examiner*—Lowell A. Larson

*Attorney, Agent, or Firm*—Abelman Frayne & Schwab

[57] ABSTRACT

A female grooving roll for use in the roll-grooving of thin-walled metal pipe has the capability of being self-tracking, thus eliminating the need for mechanical or manual skewing of the pipe during the rolling operation to prevent spiraling of the pipe off the female grooving roll, the female grooving roll being in the form of a frustum of a cone having either axially straight, axially stepped or axially curvilinear sides.

14 Claims, 3 Drawing Sheets

SELF-TRACKING ROLL FOR GROOVING THIN WALLED PIPE

FIELD OF THE INVENTION

This invention relates to a roll to be employed in the grooving of thin-walled metal pipe, particularly a short length of such thin-walled metal pipe, and which is capable of performing the groove rolling operation without any need to skew the pipe axis relative to the axis of the grooving roll, the skewing of the axis of the short length of metal pipe being performed automatically by the grooving roll itself.

BACKGROUND OF THE INVENTION

The grooving of thin-walled metal pipe is well-known in the art, and, has particular advantage in those circumstances in which the roll-grooved thin-walled pipe is to be employed in conjunction with a segmented pipe coupling.

The roll-grooving of such thin-walled metal pipe can readily be accomplished by a groove rolling machine, a typical example of such a roll grooving machine being that shown in Thau, Jr. et al U.S. Pat. No. 3,903,722 issued Sep. 9th, 1975.

Segmented pipe couplings also are well known in the art, typical examples being those shown in Blakely U.S. Pat. No. 3,695,638 issued Oct. 3rd, 1972, in Webb U.S. Pat. No. 4,601,495 issued Jul. 22nd, 1986, and, Rung et al, U.S. Pat. No. 4,639,020 issued Jan. 27th, 1987. The segmented pipe couplings disclosed in those patents have equal applicability to pipe or fittings that have been machine cut grooved, in which event the pipe must be of appreciable thickness in order to accommodate the cutting of the groove, and, to thin-walled pipe in which a groove has been provided by a rolling operation performed on the thin-walled metal pipe.

Typically, in the groove rolling of long lengths of thin walled metal pipe, the pipe is supported on a cradle, which permits rotation of the pipe about the longitudinal axis of the pipe as the roll-grooving operation proceeds. There also exists the possibility of skewing the cradle, and thus the longitudinal axis of the pipe, relative to the longitudinal axes of the respective grooving rollers. Skewing of the axis of the thin-walled metal pipe relative to the axes of the grooving rollers is essential in order to inhibit spiraling of the pipe off the female grooving roller, and out of the pinch of the respective male and female grooving rollers, which otherwise will occur due to distortion produced in the pipe end during the rolling operation, as is well known in the art.

While this is less of a problem in the event that a long length of thin-walled metal pipe is to be grooved at its end, it does pose problems in circumstances where a short length of thin walled metal pipe is to be grooved. To effect roll grooving of short length of thin-walled metal pipe, either a special jig has to be provided to hold the short length of pipe with its longitudinal axis appropriately skewed relative to the axes of rotation of the grooving rollers, or, it is necessary for the short length of thin-walled metal pipe to be manually held, positioned and manipulated during the groove rolling operation, particularly at the commencement of the groove rolling operation.

Thin-walled metal pipe typically is pipe formed from an iron or steel, or formed from copper or stainless steel, stainless steel thin-walled metal pipe exhibiting the smallest wall thickness of the pipe, and, in turn, exhibiting the greatest tendency to spiral off the female grooving roll during the rolling operation, the extremely thin walled stainless steel metal pipe being more readily deformable during the rolling operation than its more substantial iron, steel counterparts.

The reasons why thin-walled metal pipe must be restrained against spiraling off the female grooving roll and why the axis of the thin-walled metal pipe must be skewed relative to the axes of the grooving rollers is discussed later in this specification.

SUMMARY OF THE INVENTION

An object of this invention is to provide a grooving roll for thin-walled metal pipe that eliminates the need to skew the axis of the metal pipe relative to the axes of the respective grooving rollers, with a further object of permitting roll-grooving of short length of thin-walled metal pipe in an entirely automatic manner requiring no mechanical or manual intervention during the rolling operation.

According to the present invention, the female grooving roller, instead of being truly cylindrical and axially straight as in the prior art, is formed as plurality of cylindrical axially extending surfaces, which each extend at a minor included angle to the surface of an imaginary frustum of a cone. On rotation of the female grooving roll, the linear velocity of the respective axially extending cylindrical surfaces progressively decreases in relation to the actual diameter of the successive axially extending surfaces of the female grooving roll. The major diameter of the female grooving roll is engaged by the pipe in the immediate vicinity of the pipe end, and, the diameter of the respective axially extending surfaces of the female grooving roll progressively decrease from a radially extending flange immediately adjacent the largest diameter surface of the female grooving roll to that end of the female grooving roll remote from the radially extending flange.

The radially extending flange is provided to provide an abutment for the end of the pipe at the time it is placed on the female grooving roll, and also, and totally contrary to the prior art, in order to restrain the thin-walled metal pipe from spiraling onto the female grooving roll during a rolling operation.

DESCRIPTION OF THE DRAWINGS

The invention will now be described with respect to the accompanying drawings, which illustrate a preferred embodiment of the invention, and, in which.

DISCUSSION OF THE PRIOR ART

Figure 1:
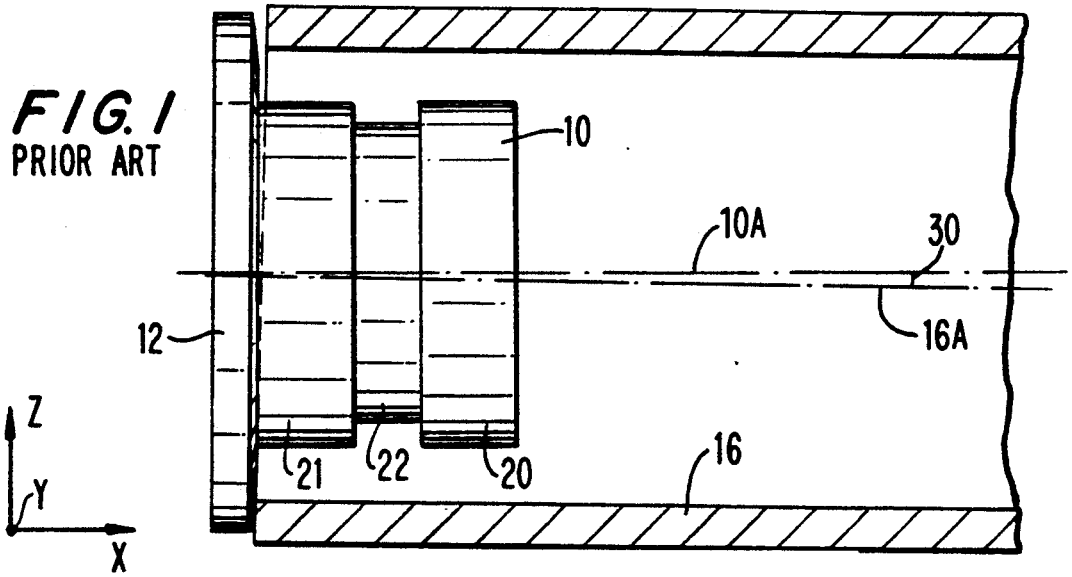
FIG. 1 PRIOR ART
FIGS. 1, 2 and 3 are diagrams illustrating the prior art problem.
Figure 2:
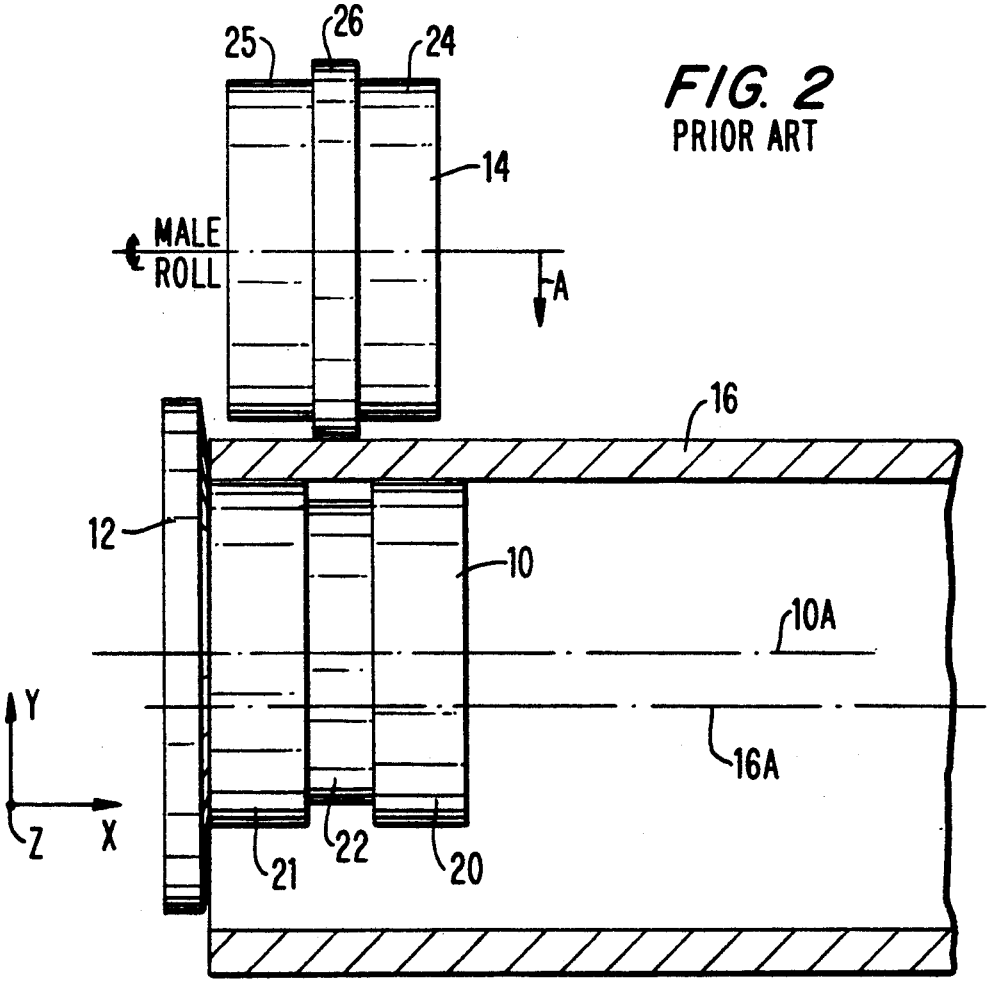
FIG. 2 PRIOR ART
Figure 3:
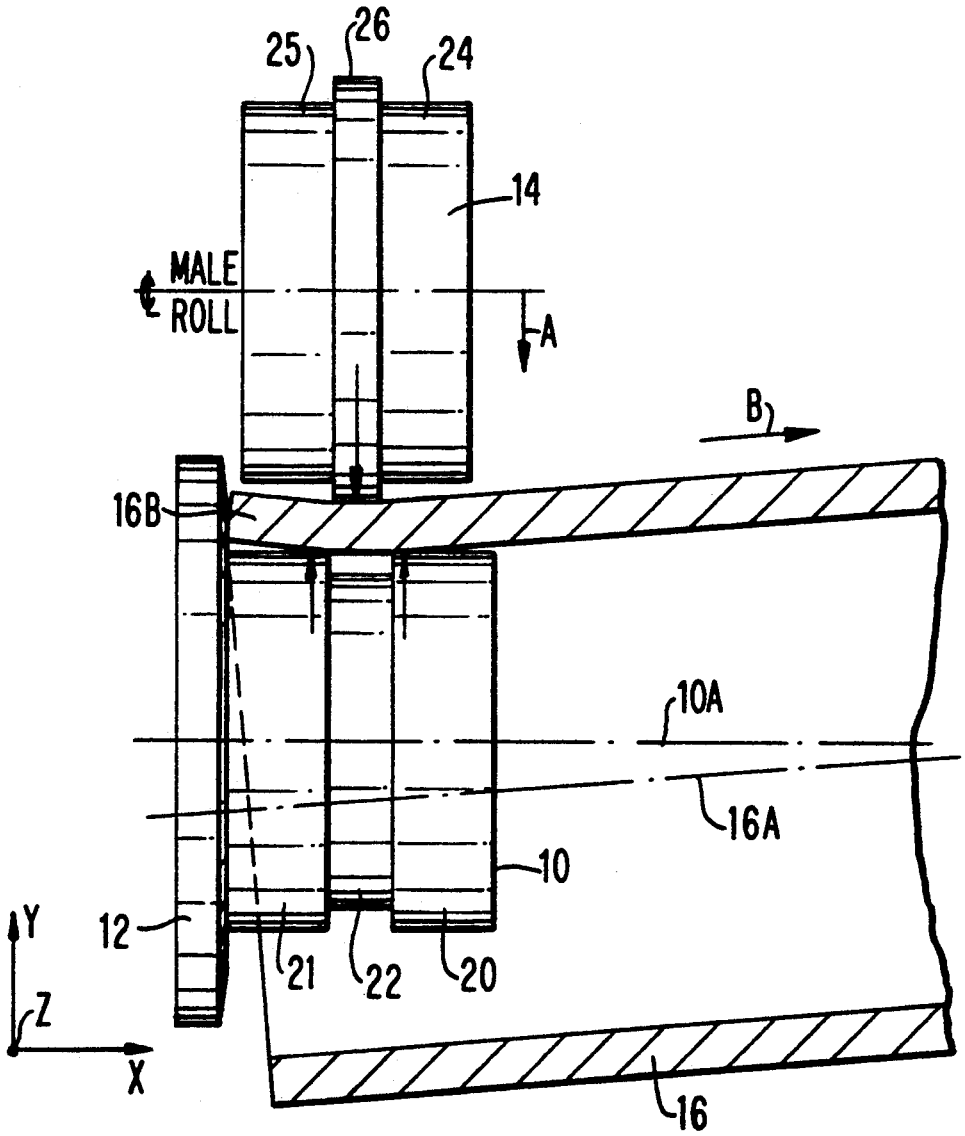
FIG. 3 PRIOR ART

FIGS. 1, 2 and 3 illustrate the positional relationship and stresses induced in the pipe during a groove rolling operation performed on thin-walled metal pipe, and employing grooving rolls according to the prior art. A female grooving roll is shown at 10, that roll having an end flange 12. A male grooving roll is shown at 14, and, a thin-walled metal pipe on which the roll-grooving operation is to be performed is shown at 16.

Also, and in order to obtain a clear indication of the positional relationships of the respective figures, the X-Y and Z have been indicated diagrammatically, in order to illustrate that FIG. 1 is a diagrammatic cross-section taken in a horizontal plane; FIG. 2 is a diagrammatic cross-section taken in a vertical plane; and FIG. 3 is a diagrammatic cross-section also taken in a vertical plane.

As will be seen in the drawings, the prior art female grooving roll is comprised of three axially straight cylindrical surfaces 20, 21 and 22, the cylindrical surface 22 providing a groove into which the material of the thin-walled metal pipe 16 is to be displaced during a groove-rolling operation. The female grooving roll is, of course, of lesser external diameter at its axially extending cylindrical portions 20 and 21 than is the internal diameter of the pipe 16, in order to permit removal of the pipe from the female grooving roll after the completion of a groove rolling operation.

The male grooving roll 14 similarly is comprised of three axially straight cylindrical portions 24, 25 and 26, the width and diameter of the cylindrical portion 26 being such that it can displace material of the pipe wall into the groove 22 in the female grooving roll upon the application of a compressive force to the male grooving roll 14 in the direction of the arrow A in FIG. 2.

As will be fully understood, the female and male grooving rolls 10 and 14 are respective mounted on arbors, one or both of which are driven by suitable motor means, such as electric motors. The male grooving roll is supported for movement towards the female grooving roll in the direction of the arrow A in any convenient manner, for example, as is taught in Thau, Jr., et al U.S. Pat. No. 3,903,722.

The pipe 16 when it is placed over the female grooving roll 10, and as is well-known in the art, of necessity, has to be placed at a skew angle 30, usually between 2° and 5°, in order to prevent spiraling of the pipe off the female grooving roller during the grooving operation. To assist in this orientation of the pipe, the side face of the flange 12 is chamfered at an appropriate angle, again, in the range of 2° to 5°.

This skewing of the pipe 15 is in the horizontal plane only, i.e., the x-z plane of FIG. 1. While initially, the axis 16*a* of the pipe 16 possibly will not be parallel to the axis 10*a* of the female grooving roll 10 in the x-y plane of FIG. 2, upon the application of pressure to the exterior of the pipe 16 by the male grooving roll 14, the axes 16*a* and 10*a* will be forced into parallelism with each other in the plane of the x and y axes, while the skewing of the respective axes in the x-z plane as illustrated in FIG. 1 is maintained.

However, and as illustrated in FIG. 3, as the pressure exerted by the male grooving roll 14 progressively increases in the direction of the arrow A, displacements will occur in the pipe wall at the line of engagement of the pipe wall by the male grooving roll 14. This is particularly so when roll-grooving a short length of pipe that has not been mechanically held against movement. At that time, the axis 16*a* of the pipe 16 will assume, as can be manually sensed by a manual operator, an acute angle relative to the axis 10*a* of the female rolling die, and, that portion of the pipe that is engaged by the cylindrical portion 26 of the male grooving roll will be depressed downwardly.

This causes the immediately adjacent portion of the pipe to assume a somewhat conical condition as indicated at 16*b* in FIG. 3, i.e., a condition simulating an increase in diameter of the pipe 16, which, in turn, has a higher speed of linear movement than does the pipe itself. This increase in the speed of linear movement of the surface of the pipe at the location 16*b* as related to the pipe itself, then acts to cause the pipe to spiral off the female grooving roll 10. The portion 16*b*, due to its higher linear velocity, will then be acting to drive the male roller at a higher speed, and further, the pipe axis 16*a* has then become displaced in two directions, i.e., both in the x-z plane, and also in the x-y plane.

This effectively provides screw thread pitch angle, and, the pipe will then respond to that screw thread pitch angle in the same manner as if it was actually screw-threaded, the pitch angle of the screw thread being in a direction to move the pipe 16 in a rightwards direction in FIGS. 1, 2 and 3, which, if unrestrained, will result in the pipe completely spiraling off the female grooving roll upon commencement of the grooving operation.

As previously mentioned, this does not pose a major particular problem when roll-grooving long lengths and relatively heavy sections of metal pipe which have been supported in a cradle. It does, however, constitute a most pressing problem when roll-grooving relatively short lengths of thin-walled metal pipe. Unless that pipe is mechanically held, it will immediately spiral off the female grooving roll. If it is manually held, then the operator must apply sufficient force to the pipe to force it leftwards into engagement with the flange 12, in order to prevent the spiraling off of the pipe from the female grooving roll.

This in itself is a difficult operation in that the pipe 16 is rotating at an angular velocity determined by the speed of rotation of the female grooving roll, and thus, cannot merely be held by the operator. Instead, the operator must exercise considerable dexterity to maintain the grooving operation on track and prevent the spiraling effect of the pipe 16 off the female grooving roll.

In turn, this can result in a rolled groove, the sides of which deviate from a plane perpendicular to the axis 16*a* of the pipe, i.e., the groove produced will not necessarily be spaced an exact distance from the end wall of the pipe throughout its circumferential extent.

DESCRIPTION OF THE PREFERRED EMBODIMENTS

Figure 4:
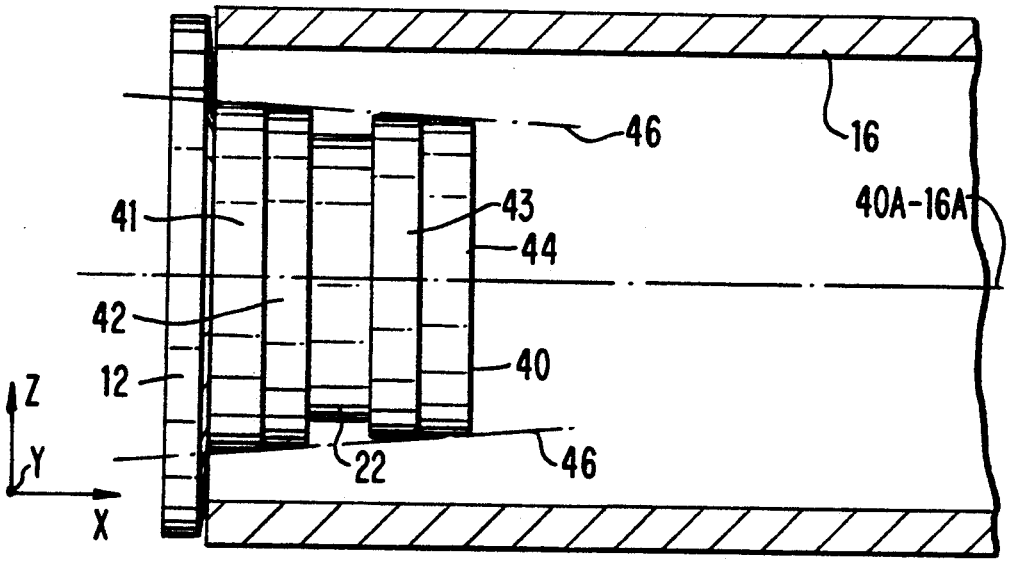
FIGS. 4 and 5 are diagrams illustrating the manner in which the problem of the prior art is overcome by the present invention.
Figure 5:
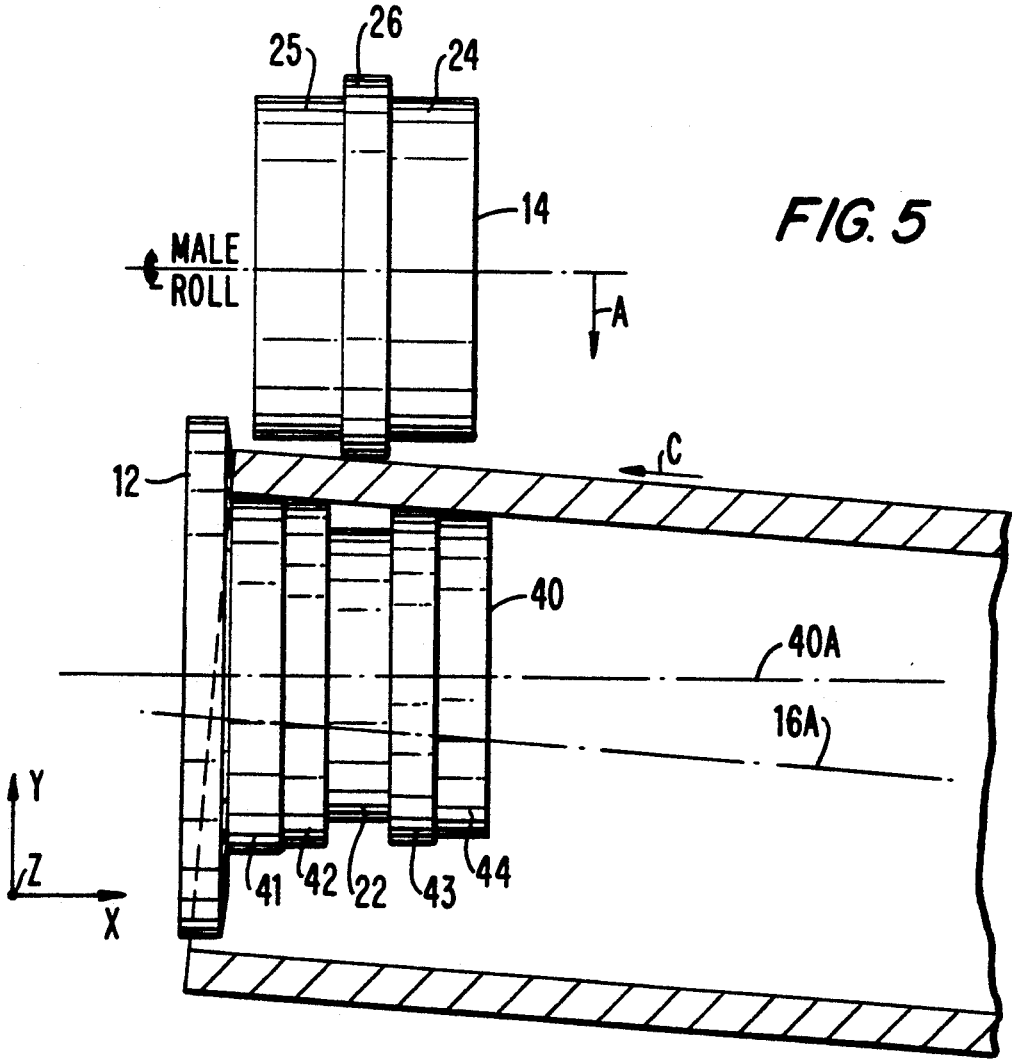

This problem in the prior art is overcome by the present invention by reconfiguring the female grooving roll 40 for it to have a plurality of cylindrical surfaces that intersect the surface of a frustum of a cone, indicated by the chain lines 46 in FIG. 4, FIG. 4 being a diagrammatical cross-section taken in the x-z plane, and FIG. 5 being a diagrammatical cross-section taken in the x-y plane.

Referring now to FIG. 4, it will be seen that the pipe 16 does not need to be skewed in the x-z plane, and, that in that plane the axis 40*a* of the female grooving roll 40 are truly coincident, i.e., the pitch angle referred to with respect to FIGS. 1, 2 and 3 has been eliminated.

The female grooving roll 40 is comprised a plurality of cylindrical sections 41, 42, 43, and 44, which flank the conventional groove 22 into which material of the wall of the pipe 16 is to be displaced during the rolling operation.

The male grooving roll 14 is the same as the grooving roll described with reference to the prior art, the male grooving roll 14, as shown in FIG. 5 being comprised of axially straight truly cylindrical sections 24, 25 and 26, the male grooving roll 14 in the same manner being moved in the direction of the arrow A.

Referring more particularly to FIG. 5, when the male grooving roll moves into compressive engagement with the pipe 16, the pipe 16 and its axis 16a automatically are forced into an angle of inclination relative to the axis 40a of the female grooving roll 40 opposite to that which occurs in FIG. 3. The cylindrical portion 26 of the male grooving roll 14 then initially engages the exterior surface of the pipe 16, and will attempt to ride down the inclined surface of the pipe 16. However, as the roller 14 cannot move axially, any forces generated by this engagement of the cylindrical portion 26 of the male grooving roll 20 with the pipe 16 will act to move the pipe 16 axially in a leftwards direction and will maintain the end of the pipe 16 in compressive abutting relation with the juxtaposed surface of the flange 12.

As the groove rolling operation proceeds, that portion of the pipe 16 intermediate the cylindrical portion 26 and the end flange 12 will flare outwardly in the manner illustrated in FIG. 3, but, this is of no consequence in that the skew angle 30 illustrated in FIG. 1 has been eliminated, and thus, the cylindrical portion 26 will merely traverse the exterior surface of the pipe 16 along a truly linear path lying in a plane perpendicular to the axis 40a of the female grooving roll 40.

Thus, while the pipe 16 must be manually held until such time as the cylindrical portion 26 of the male grooving roll 14 compressively engages the surface of the pipe 16, then, the operator can release the pipe 16, and, the grooving operation will continue without any need for intervention by the operator, who can then immediately release the pipe 16, and, then permit the roll-grooving operation to proceed under its own control without any need for manual intervention by the operator, in that immediately the pipe 16 has been compressively engaged by the female grooving roll 40 and the male grooving roll 14, the operation of the respective grooving rolls 14 and 40 becomes self-tracking, and, self-adjusting. For example, if the operator inadvertently inserts the pipe 16 between the grooving rolls 14 and 40 without it being in engagement with the flange 12, upon engagement of the pipe 16 by the male grooving roll 14, which will be attempting to run down the inclined surface of the pipe 16, will immediately force the end of the pipe 16 into the proper seating engagement with the end flange 12. Instead of the pipe 16 attempting to thread or spiral off the female grooving roll 10 in the direction of the arrow B in FIG. 3, the axial forces imposed on the pipe 16 will be in the reverse direction and in the direction of the arrow C in FIG. 5.

The female grooving roll, which is power-driven, will have the further beneficial effect of forcing the pipe C leftwards in the direction of the arrow C in FIG. 5, this being due to the slight difference in linear velocity between the cylindrical portion 41 and the slightly lower linear velocity of the portions 42, 43 and 44. This difference in linear velocities will initially cause a skewing of the pipe in the x-z plane in the event that there is no manual restraint imposed on the pipe, in the same manner as that deliberately imposed in FIG. 1 by skewing at the acute angle 30, the generation of that minor skewing action having the beneficial effect of forcing the pipe leftwards in the direction of the arrow C in a similar manner to that intended in FIG. 1, but with a cumulative effect of causing the pipe 16 to spiral onto the female grooving roll 40.

According to the present invention, the female grooving roll 40 could in fact be formed as a frustum of a cone as indicated by the chain lines 46. This, however, would cause complications in the desired knurling of the surfaces of the cylindrical portions 41–44, which is relatively easy to provide on a cylindrical surface, but is difficult to provide on a tapered surface due to the continuous change in diametrical pitch of the taper.

In FIG. 4, the female rolling die 40 is shown as a frustum of a stepped cylindrical pyramid, in which the stepped edges of the respective cylindrical portions 41–44 each lie on the surface of a straight-sided imaginary cone 46. Other configurations are possible, in which the stepped edges of the cylindrical portions 41–46 lie on the surface of a frustum of a cone having curvilinear sides.

The major requirement of the female rolling die 40 of the invention is, of course, that it be of greater diameter at its end adjacent the flange 12 than it is at all positions intermediate the end adjacent the flange 12 and the opposite end of the grooving roll, this constituting a major difference from the prior art grooving roll.

As will be easily understood, if a solid cylinder of constant radius throughout its axial length is placed within a tube, the solid cylinder [ignoring frictional restraints] will come to rest with its longitudinal axis extending truly parallel to the axis of the hollow cylinder. If now the position of the solid cylinder is fixed and thus the longitudinal axis of the cylinder, then, the only possibility of moving the axis of the hollow cylinder out of parallel alignment with the axis of the solid cylinder is by means of forcing the axes of the respective cylinders towards each other, at which point the solid cylinder will only engage the interior of the hollow cylinder at the respective ends of the solid cylinder.

If, now, as is conceptualized by the present invention, the solid cylinder is re-formed as a frustum of a cone, then, within the extent of reduction in the diameter of the small end of the frustum, the hollow cylinder can pivot about the point of engagement of the large end of the frustum with the interior of the hollow cylinder, and, the hollow cylinder is free to skew relative to the axis of the solid cylinder, in the manner illustrated in FIG. 5 of the drawings.

Such a skewing of the axis of the hollow cylinder relative to the axis of the solid cylinder, occurs in a single plane, i.e., the y-y plane, to the total exclusion of any skewing of the longitudinal axis of the hollow cylinder in the x-z plane. Thus, the male grooving roller 14 "sees" only a circumference on the pipe 16 that lies in a plane perpendicular to the axis 16a of the pipe 16. As that circumferences lies in a single plane, there are no forces produced that simulate a thread pitch angle. In the presence of such a thread pitch angle, the pipe will spiral off the grooving rollers. A reversal of the thread pitch angle, such as is produced mechanically or manually in FIG. 1 would have the effect of either removing the tendency of the pipe to spiral off the rollers, or possibly in some circumstances, act to cause the pipe to spiral even further onto the rollers. This can be further visualized as the effects on a straight steel rule if passed through the pinch of a pair of rollers. If the sides of the rule are truly perpendicular to the axes of the respective rollers, then, the rule will proceed on a truly straight line pass between the respective rollers. If, however, the sides of the rule are not truly perpendicular to the axes of the respective rollers, then, the leading end of the rule will progressively move in a direction axially of the rollers, that portion of the rule located within the pinch of the rollers remaining axially fixed. Proceeding further, if one then bows the ends of the steel ruler about a cylinder having its axis parallel to the axes of the roll, then, the ruler will end up in the form of a spiral simulating the spiral of a screw thread. If the pipe then simulates a screw thread, the rollers then simulate a nut threaded onto the screw thread, relative movement between the pipe and the rollers then acting in the manner of either unthreading the screw thread from the nut, or, unthreading the nut from the screw thread.

In the rolling of a thin-walled metal pipe of four inches or more, i.d., typically a female grooving roll of 3.5 inches nominal diameter will be employed, that diameter representing the diameter of the cylindrical portion 41.

The respective cylindrical surface portions 42, 43 and 44, then will have external diameter of 3.493 inches, 3.467 inches and 3.460 inches, the axial width of the respective cylindrical portions 41–44 being 0.20 inches. These diameters are, of course, the nominal diameters of the respective cylindrical portions prior to knurling. After knurling, the respective diameters will vary slightly from the initial diameter, the main diameter remaining constant.

The various modifications in the grooving roll described above as a preferred embodiment can be made without departing from the scope of the appended claims. For example, while four knurled cylindrical portions 41–44 have been illustrated, if grooving is to be effected on larger diameters of pipes, obviously, more than four such cylindrical portions 41–44 can be employed. In fact, the cylindrical portions 41–44 could be eliminated in their entirety, and, the female grooving roll be made exactly in the form of a frustum of a cone. This, however, then would require different techniques in providing knurling on the exterior surface of the female grooving roll, which could be effected, but at far greater expense by machine engraving of the external surface of the female grooving roll. An alternative to knurling would be the provision of axially extending teeth on the exterior surface of the female grooving roll, which could be effected by a broaching operation. Such an operation is, however, encumbered with the same problems as knurling a surface which is other than a straight cylinder.

While, in the preferred embodiment, the flange 12 has been shown as integral with the female grooving roll 40, the flange 12 can be entirely independent of the grooving roll, and also, can be freely rotatable relative to the grooving roll, such as by mounting it on an anti-friction bearing. As it is not mandatory that the flange 12 rotate in unison with the roll 40, the flange 12, at the expense of increased frictional restraint on movement of the pipe, could in fact be a fixed guide secured to the frame of the groove rolling machine.

The actual dimensions of the forming groove will, of course, be dictated by the dimensions of the form-rolled groove, and, the wall thickness of the thin-walled pipe that is to be rolled.

What is claimed is:

1. A self-tracking female grooving roll for use in the roll-grooving of thin-walled metal pipe, said female grooving roller including:

a cylindrical body having a first axial end, an opposite second end axial end, and longitudinal axis of rotation;

said cylindrical body providing a first body portion extending from said first end to a position intermediate said first and second ends;

a second body portion extending from said second end to a position intermediate said first and second ends; and a third portion providing a groove in said cylindrical body at a position intermediate said first and second portions;

said first body portion being of decreasing radius from said longitudinal axis at all positions intermediate said first axial end and said intermediate third portion;

said second body portion being of decreasing radius from said longitudinal axis at positions intermediate said intermediate portion and said second axial end, and, at all positions being of lesser radius from said longitudinal axis than the maximum radius of said first body portion.

2. The self-tracking female grooving roll according to claim 1, in which said first body portion includes adjacent axially-straight cylindrical surface portions which progressively decrease in diameter from said first axial end.

3. The self-tracking female grooving roll of claim 2, in which said first portion has surface portions positioned within an imaginary cone having its longitudinal axis coincident with said longitudinal axis of said female grooving roll, and having the base of said imaginary cone extending perpendicular to said longitudinal axis at said first end.

4. The self-tracking female grooving roll of claim 1, in which said second portion includes adjacent axially straight cylindrical surface portions progressively decreasing in diameter from said intermediate portion to said second axial end.

5. The self-tracking female grooving roll according to claim 4, in which said second portion has surface portions positioned within an imaginary cone having its longitudinal axis coincident with said longitudinal axis of said female grooving roll, and having the base of said cone extending perpendicular to said longitudinal axis at said intermediate portion.

6. The self-tracking female grooving roll of claim 1, in which said first and second portions each have surface portions positioned within the surface of an imaginary cone having its longitudinal axis coincident with said longitudinal axis of said female grooving roll, the base of said imaginary cone extending perpendicular to said longitudinal axis at said first end of said cylindrical body.

7. The self-tracking female grooving roll of claim 6, in which said imaginary cone is an axially rectilinear cone.

8. The self-tracking female grooving roll of claim 6, in which said imaginary cone is an axially curvilinear cone.

9. The self-tracking female grooving roll of claim 1, in which said first and second portions of said cylindrical body each include a plurality of cylindrical portions arranged in stepped relationship, a said cylindrical portion adjacent said first end being of greater radius from said longitudinal axis than each of said other cylindrical portions.

10. The self-tracking female grooving roll of claim 9, in which said cylindrical portions are arranged in the form of a frustum of a stepped cylindrical pyramid.

11. The self-tracking female grooving roll of claim 1, in which said first body portion and said second body portion, in combination, define an axially straight frustum of a cone.

12. The self-tracking female grooving roll of claim 1, in which said first body portion and said second body portion, in combination, define an axially stepped frustum of a conical stepped pyramid.

13. The self-tracking female grooving roll of claim 1, in which said first body portion and said second body portion, in combination, define an axially curvilinear frustum of a cone.

14. The self-tracking female grooving roll of claim 1, in which said first and second body portions are of substantially equal axial length.

* * * * *